US008042920B2

(12) United States Patent
Nishimori

(10) Patent No.: US 8,042,920 B2
(45) Date of Patent: Oct. 25, 2011

(54) FLUID SUPPLY APPARATUS AND IMAGE FORMING APPARATUS

(75) Inventor: Takehiro Nishimori, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 358 days.

(21) Appl. No.: 12/431,948

(22) Filed: Apr. 29, 2009

(65) Prior Publication Data

US 2009/0295884 A1 Dec. 3, 2009

(30) Foreign Application Priority Data

May 30, 2008 (JP) ..... 2008-142130

(51) Int. Cl.
*B41J 2/17* (2006.01)
*B41J 2/175* (2006.01)

(52) U.S. Cl. ..... 347/84; 347/85; 347/86

(58) Field of Classification Search ..... None
See application file for complete search history.

(56) References Cited

U.S. PATENT DOCUMENTS 6,132,027 A * 10/2000 Suzuki et al. ..... 347/33
2008/0218571 A1 9/2008 Nishimori

FOREIGN PATENT DOCUMENTS

| | | |
|---|---|---|
| JP | 60-256577 | 12/1985 |
| JP | 2002-370374 | 12/2002 |
| JP | 2004-223829 | 8/2004 |
| JP | 2004-351641 | 12/2004 |

* cited by examiner

*Primary Examiner* — Matthew Luu
*Assistant Examiner* — Renee Wilson
(74) *Attorney, Agent, or Firm* — Cooper & Dunham LLP

(57) ABSTRACT

A fluid supply apparatus enables the direction of movement of a fluid to be changed easily while maintaining high barrier property and durability. The fluid supply apparatus includes an upper cylinder having a first and a second supply/discharge opening for supplying or discharging a fluid. A piston is movably disposed within a lower cylinder, forming a cylinder internal chamber. A fluid channel open/close member is rotatably disposed in the upper cylinder. The fluid channel open/close member opens or closes a channel communicating the first or the second supply/discharge opening with the cylinder internal chamber, while closing at least one of the first and the second supply/discharge openings at any time. The rotation of the fluid channel open/close member is linked with the movement of the piston by a cam groove and a cam pin.

5 Claims, 17 Drawing Sheets

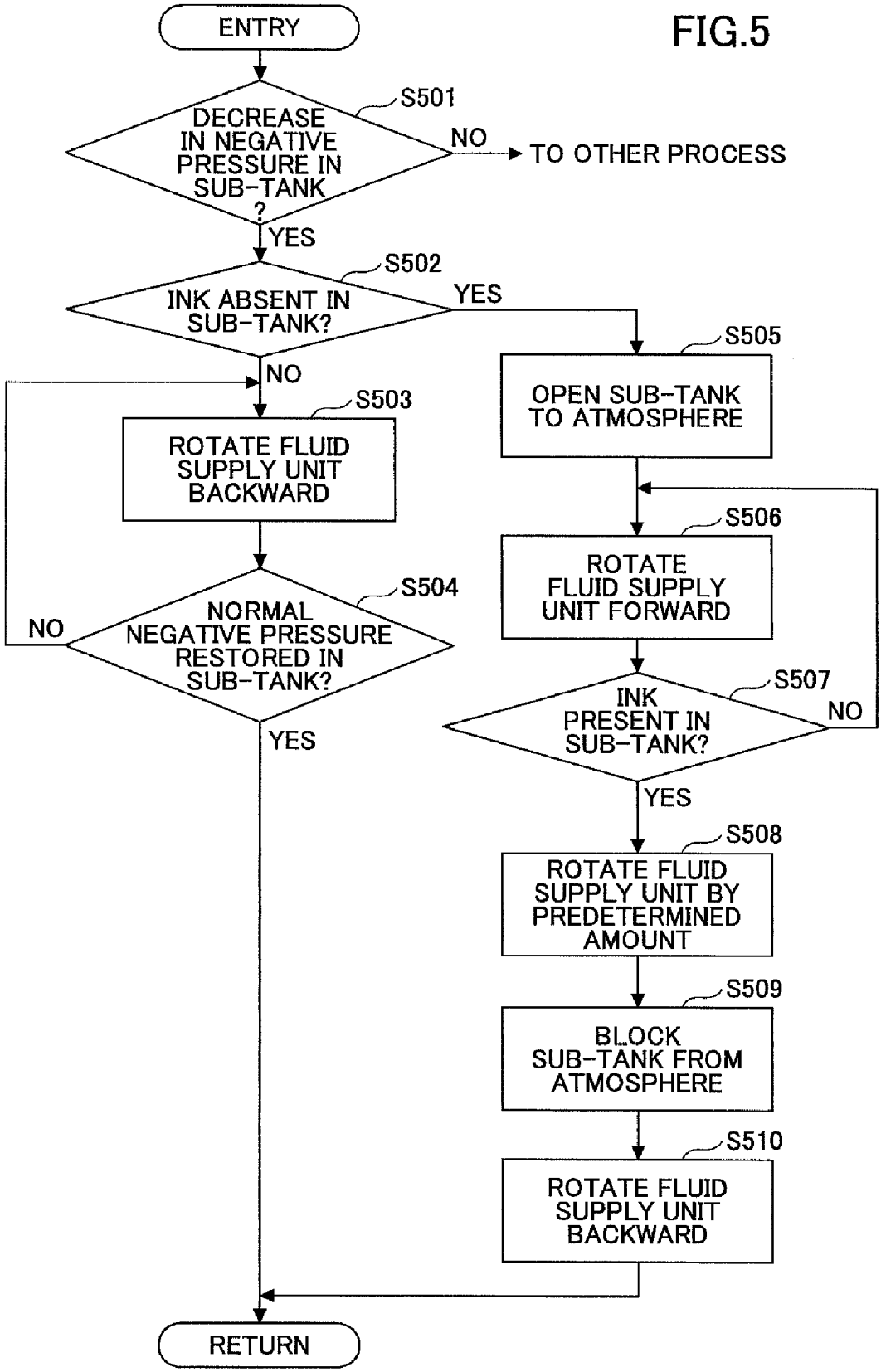
FIG.5
ENTRY
S501
DECREASE IN NEGATIVE PRESSURE IN SUB-TANK ?
NO
TO OTHER PROCESS
YES
S502
INK ABSENT IN SUB-TANK?
YES
NO
S503
ROTATE FLUID SUPPLY UNIT BACKWARD
S504
NORMAL NEGATIVE PRESSURE RESTORED IN SUB-TANK?
NO
YES
S505
OPEN SUB-TANK TO ATMOSPHERE
S506
ROTATE FLUID SUPPLY UNIT FORWARD
S507
INK PRESENT IN SUB-TANK?
NO
YES
S508
ROTATE FLUID SUPPLY UNIT BY PREDETERMINED AMOUNT
S509
BLOCK SUB-TANK FROM ATMOSPHERE
S510
ROTATE FLUID SUPPLY UNIT BACKWARD
RETURN

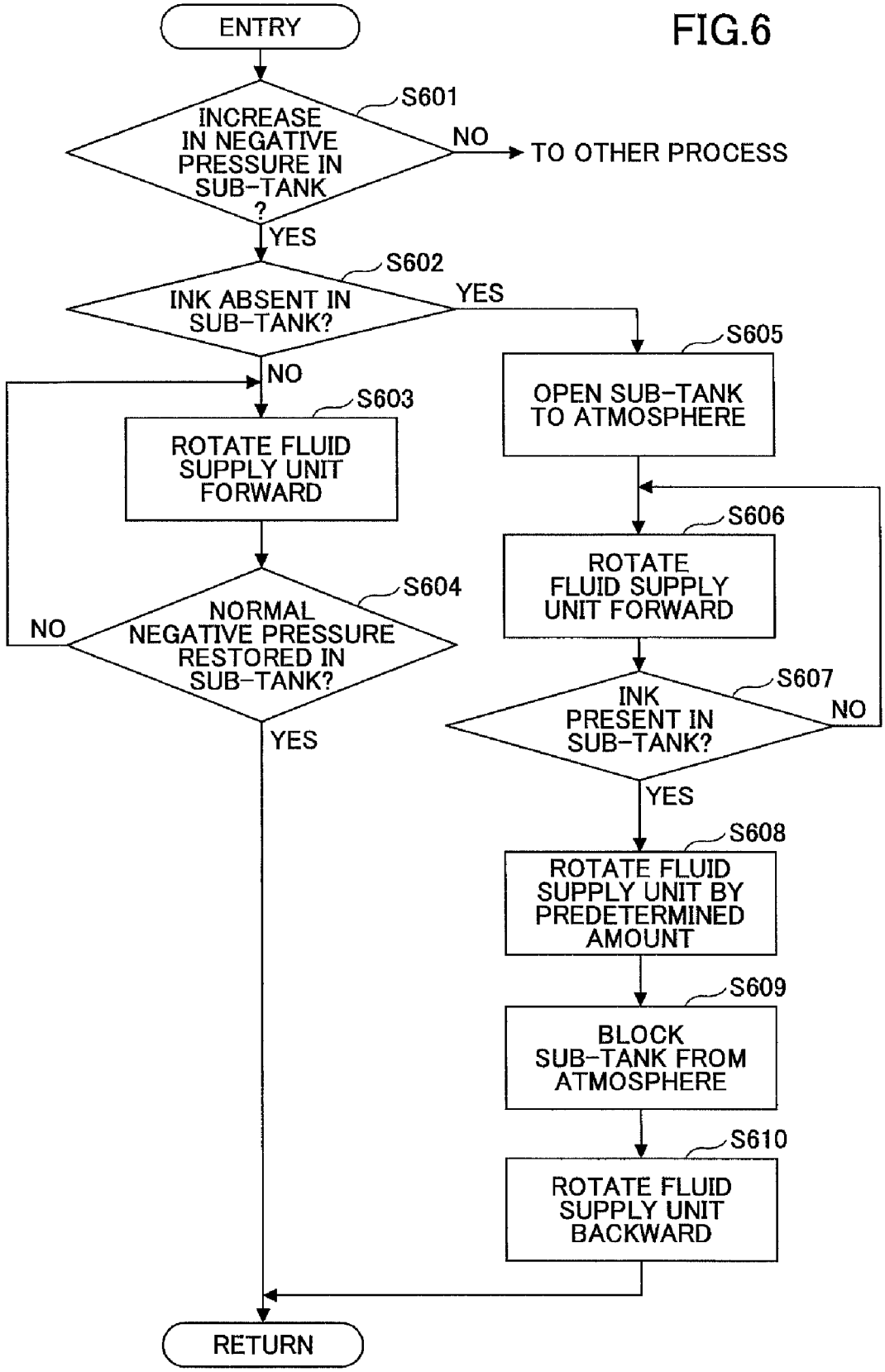
FIG.6
ENTRY
S601
INCREASE IN NEGATIVE PRESSURE IN SUB-TANK ?
NO
TO OTHER PROCESS
YES
S602
INK ABSENT IN SUB-TANK?
YES
NO
S603
ROTATE FLUID SUPPLY UNIT FORWARD
S604
NORMAL NEGATIVE PRESSURE RESTORED IN SUB-TANK?
NO
YES
S605
OPEN SUB-TANK TO ATMOSPHERE
S606
ROTATE FLUID SUPPLY UNIT FORWARD
S607
INK PRESENT IN SUB-TANK?
NO
YES
S608
ROTATE FLUID SUPPLY UNIT BY PREDETERMINED AMOUNT
S609
BLOCK SUB-TANK FROM ATMOSPHERE
S610
ROTATE FLUID SUPPLY UNIT BACKWARD
RETURN

FLUID SUPPLY APPARATUS AND IMAGE FORMING APPARATUS

BACKGROUND OF THE INVENTION

1. Field of the Invention

The present invention generally relates to fluid supply apparatuses and image forming apparatuses, and more particularly to a reversible fluid supply apparatus in which the direction of transport of a fluid can be switched, and to an image forming apparatus equipped with such a fluid supply apparatus.

2. Description of the Related Art

There are various types of image forming apparatus, such as printers, facsimile machines, copiers, plotters, and multifunction peripherals. Inkjet recording apparatuses are an example of the image forming apparatus of a fluid-discharge recording type. In this type of image forming apparatus, typically droplets of ink are discharged out of a recording head onto a recording medium as the recording medium is transported, thereby forming an image on the recording medium. By "forming an image" is meant that an image is either recorded, transferred, or printed, for example.

There are two types of inkjet recording apparatus. One is the serial-type by which droplets of ink are discharged while the recording head is moved in a main scan direction, thereby forming an image on the recording medium. The other is the line type which employs a line head to discharge ink droplets to form an image without moving the recording head.

The term "recording medium" includes a sheet of paper, threads, fibers, fabrics, leather, metals, plastics, glass, wood, and ceramics, for example. The term "image" formed on the recording medium includes both images with some meaning, such as a certain character or a figure, and images without particular meanings, such as a random pattern, which may be formed by landing ink droplets on the medium randomly.

The term "ink" is intended to refer to any fluid with the use of which an image can be formed. Such fluid may be referred to as a recording fluid or a fixing solution. The term "sheet" is intended to refer to not just a sheet of paper but also any sheet on which ink droplets can attach, such as an overhead projector (OHP) sheet, cloth, etc. The "sheet" therefore include a recording medium, a recording paper, a recording sheet, and the like.

In the fluid discharge type of image forming apparatus, two ways of supplying ink to the recording head are known. In one, an ink cartridge, i.e., an ink container, is removably attached to the carriage. The ink is supplied from the ink cartridge to the recording head, which is mounted on the carriage. In the other, a smaller-volume sub-tank (also referred to as a "head tank" or a "buffer tank") is mounted on the carriage. The sub-tank supplies ink to the recording head. A larger-volume ink cartridge (main tank) is replaceably attached to the apparatus main body. The sub-tank is refilled with ink from the main tank on the main apparatus side.

In the latter system, in which the main tank can be replaced, the main tank and the head tank are connected via an ink supply channel (fluid supply channel). The fluid supply channel is often made from a flexible resin tube for ease of handling within the apparatus, assembly, and maintenance.

As the speed of printing operations increases, there is a corresponding demand for faster carriage movement. This leads to increased vibrations in the fluid supply channel, such as a supply tube, as it follows the moving carriage. As a result, pressure variations are caused in the ink in the supply channel relative to the recording head. In order to reduce the pressure variations, various complex pressure damping mechanisms have been devised. A structure has also been adopted in which fluid communication between the main tank and the sub-tank is disconnected by blocking the supply channel with a valve or the like.

Because the soft resin tubes have a low gas barrier property, external air may enter (or permeate) the tube when used as the fluid supply channel, producing bubbles in the tube. Air may also enter the supply channel via the connecting portion between the supply channel and the main tank or the sub-tank. If air enters the supply channel, the air reaches the sub-tank due to a predetermined negative pressure formed therein, thereby reducing the pressure within the sub-tank and causing the ink to drip out of the nozzle surface of the recording head.

To overcome this problem, the air that entered the sub-tank may be discharged to the atmosphere, followed by sucking the ink out of the nozzle surface of the recording head using a suction pump, so that a predetermined pressure (negative pressure) can be restored in the sub-tank. In this method, however, a large amount of waste ink is produced by the sucking of ink from the nozzle opening, which is not economical.

In another solution, the ink within the supply channel may be fed back to the main tank in order to control the pressure within the head tank, using various methods or pumps for changing fluid transport directions for suction or discharge.

For example, Japanese Laid-Open Patent Application No. 2004-351641 (hereafter referred to as "Patent Document 1") discloses a system in which parallel circulation channels are formed such that they do not pass near the recording head nozzle, wherein the ink and bubbles within the sub-tank are fed back to the main tank by a force-feed unit.

Japanese Laid-Open Patent Application No. 2002-370374 (hereafter referred to as "Patent Document 2") discloses a system in which the internal volume of the sub-tank is compulsorily changed in a decreasing direction so that the bubbles within the sub-tank can flow back to the main tank together with the ink.

Japanese Laid-Open Patent Application No. 60-256577 (hereafter referred to as "Patent Document 3") discloses a pump system in which a shell is rotatably supported within a casing having a suction opening and a discharge opening. The inside of the shell is partitioned by a diaphragm into a pump chamber and an operating fluid chamber. The pump chamber has an opening that can be communicated with the suction opening or the discharge opening as the shell is rotated.

However, in the system according to Patent Document 1, the details of the ink force-feed unit are unclear, and the system requires the two parallel circulating channels for each color. As a result, the arrangement of the channels within the apparatus is complicated, making assembly of the apparatus difficult and requiring an increased cost. The system according to Patent Document 2 requires the pressurizing/depressurizing unit for pressurizing or depressurizing the sub-tank in order to increase or decrease the volume of the sub-tank. Furthermore, a valve unit needs to be installed outside the carriage. As a result, the apparatus increases in size and complexity. In the pump according to Patent Document 3, the diaphragm cannot ensure sufficient resistance against the permeability of the ink.

As a general bidirectional pump capable of sucking and discharging fluid, tubing pumps are known. The tubing pump, however, is problematic in barrier property against gas permeation and durability due to its structure in which a low-hardness resilient tube is compressed by pressing rollers.

SUMMARY OF THE INVENTION

It is a general object of the present invention to provide an apparatus in which one or more of the aforementioned problems are eliminated.

A more specific object of the present invention is to provide an apparatus that, while maintaining high barrier property and high durability against fluids, is capable of preventing the entry of external pressure and changing the fluid transport direction easily.

According to one aspect of the present invention, a fluid supply apparatus includes a cylinder having a first supply/discharge opening and a second supply/discharge opening for supplying or discharging a fluid; a piston movably disposed in the cylinder, the piston forming a chamber with the cylinder; a rotating channel open/close unit movably disposed within the cylinder and configured to open or close a channel that communicates the first or the second supply/discharge opening with the chamber in the cylinder, wherein the rotating channel open/close unit closes at least one of the first and the second supply/discharge openings at any time; and a linking unit configured to link a rotation of the channel open/close unit and a movement of the piston.

The fluid is caused to enter the chamber via the first supply/discharge opening and exit via the second supply/discharge opening by the rotation of the channel open/close unit in one direction. The fluid is caused to enter the chamber via the second supply/discharge opening and exit the chamber via the first supply/discharge opening by the rotation of the channel open/close unit in another direction.

According to another aspect of the present invention, an image forming apparatus includes the above fluid supply apparatus.

BRIEF DESCRIPTION OF THE DRAWINGS

These and other objects, features and advantages of the invention will be apparent to those skilled in the art from the following detailed description of the invention, when read in conjunction with the accompanying drawings in which:

FIG. 5 shows a flowchart of an ink supply control process according to an embodiment;

FIG. 6 shows another flowchart of the ink supply control process;

DETAILED DESCRIPTION OF THE PREFERRED EMBODIMENTS

Figure 1:
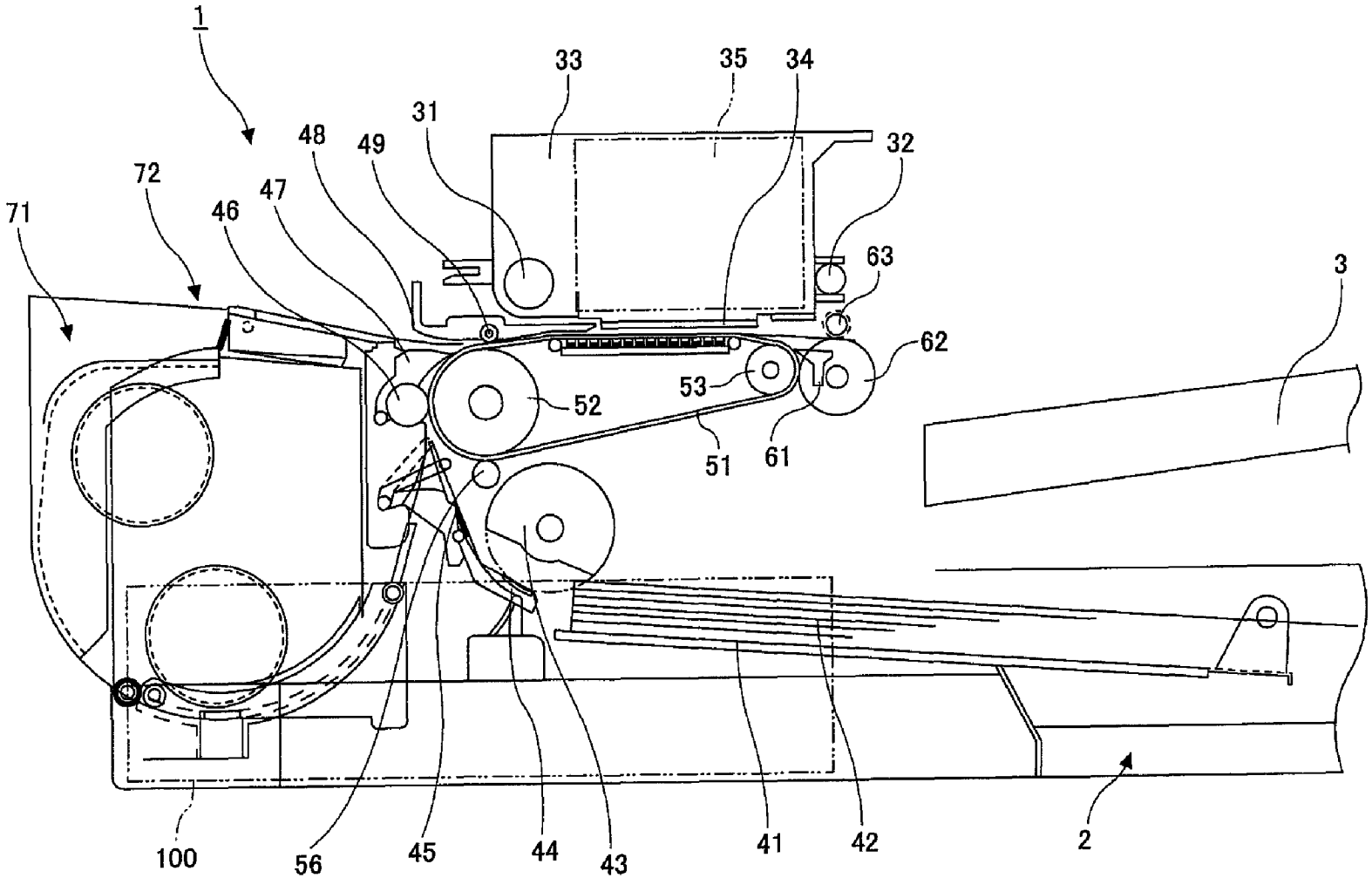
FIG. 1 shows a mechanism portion of an image forming apparatus according to an embodiment of the present invention.

Referring now to the drawings, wherein like reference numerals designate identical or corresponding parts throughout the several views, embodiments of the present invention are described.

Figure 2:
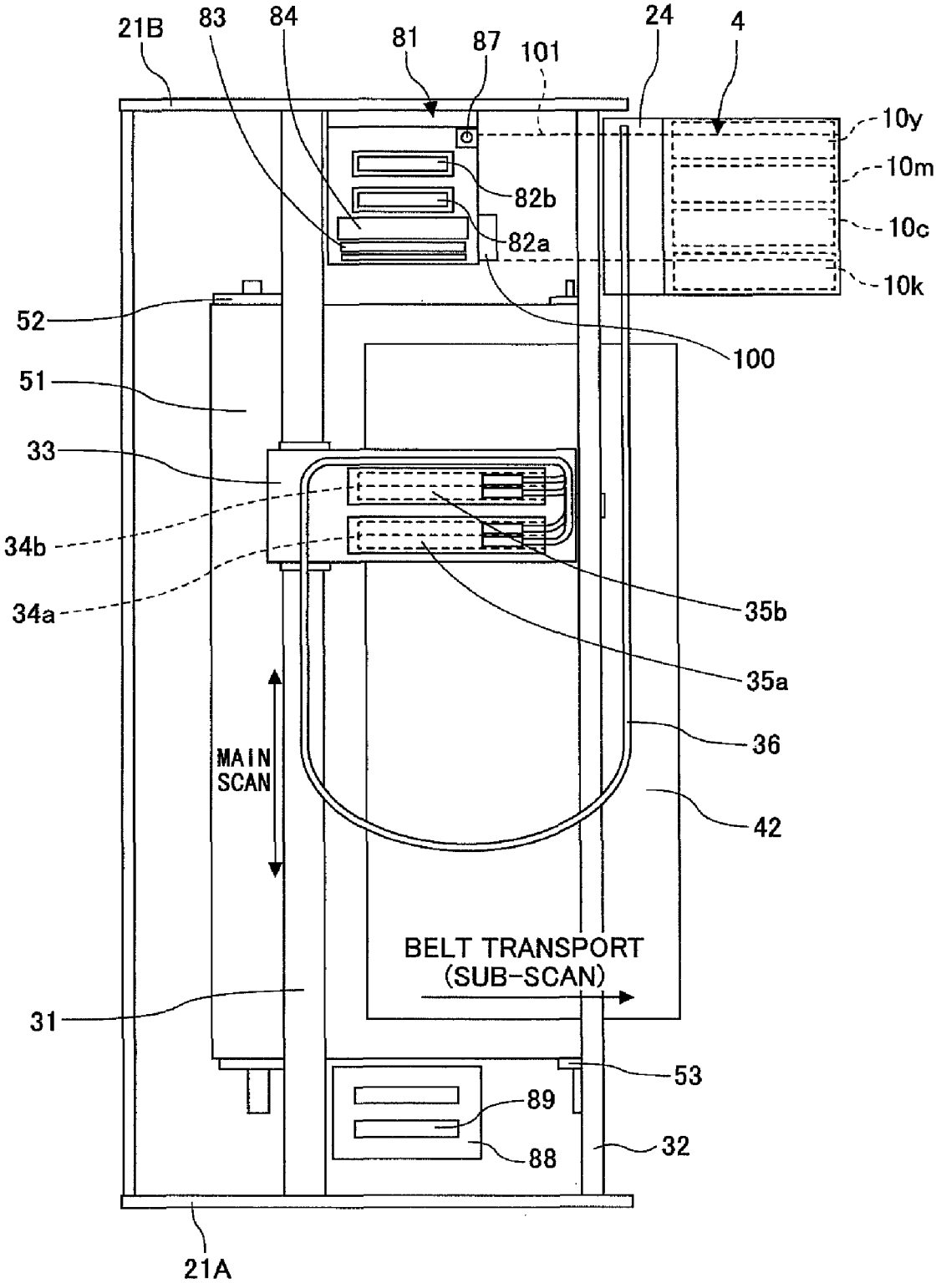
FIG. 2 shows a plan view of the mechanism portion shown in FIG. 1.

FIG. 1 shows a side view of an apparatus main body 1 of an image forming apparatus according to an embodiment. FIG. 2 shows a plan view of a main portion of the apparatus main body 1. The image forming apparatus according to the present embodiment is a serial-type inkjet recording apparatus. In the apparatus main body 1, a carriage 33 is slidably supported by a main guide rod 31 and a sub-guide rod 32. The main guide rod 31 and the sub-guide rod 32 are laterally extended between left- and right-side plates 21A and 21B of the apparatus main body 1. The carriage 33 is moved in main scan directions as shown in FIG. 2, by a main-scan motor (not shown) via a timing belt or the like.

The carriage 33 carries recording heads 34*a* and 34*b* (which may be collectively referred to as a recording head 34) for discharging ink droplets of the individual colors of yellow (Y), cyan (C), magenta (M), and black (K). The recording head 34 is directed downward and includes lines of nozzles arranged in a sub-scan direction perpendicular to the main scan direction.

Each of the recording heads 34*a* and 34*b* has two lines of nozzles. In the recording head 34*a*, one of the lines of nozzles may be configured to discharge ink droplets of (K), and the other may be configured to discharge ink droplets of (C). In the recording head 34*b*, one of the lines of nozzles may be configured to discharge ink droplets of (M) while the other may be configured to discharge ink droplets of (Y).

The carriage 33 also carries sub-tanks 35*a* and 35*b* (which may be collectively referred to as a sub-tank 35) for supplying the inks of the individual colors to the corresponding lines of nozzles of the recording head 34. The sub-tank 35 is refilled with the individual colors of ink from ink cartridges 10*y*, 10*m*, 10*c*, and 10*k* as the main tanks via supply tubes 36 for the individual colors, by a supply pump unit 24. The supply pump unit 24 is an example of the fluid supply apparatus according to an embodiment of the present invention. The ink cartridges 10*y*, 10*m*, 10*c*, and 10*k* are detachably installed in a cartridge loading unit 4.

The apparatus main body 1 also includes a sheet-feed tray 2 with a sheet mount portion (pressure plate) 41 on which one or more sheets 42 are placed. The sheets 42 are fed by a feeding unit including a half-moon roller (feed roller) 43 and a separating pad 44 disposed opposite the half-moon roller 43. The separating pad 44 is biased against the half-moon roller 43 and is made of a material with a large friction coefficient so that the separating pad 44 can catch the sheets 42 one at a time and feed the individual sheet 42 out of the sheet mount portion 41.

The sheet 42 that has been fed from the feeding unit is guided by a guide member 45, a counter roller 46, a transport guide member 47, and a pressing member 48 having an edge pressurizing roller 49. The sheet 42 is also guided, transported, and then positioned under the recording head 34 by a transport belt 51 to which the sheet 42 becomes electrostatically attached.

The transport belt 51 is an endless belt extended between the transport roller 52 and the tension roller 53, and rotated in a belt transport direction (along the sub-scan direction). The surface of the transport belt 51 is charged by a charge roller 56 as a charging unit. The charge roller 56 is disposed so that it can contact an upper layer of the transport belt 51 and rotate following the rotation of the transport belt 51. The transport belt 51 may be rotated by a sub-scan motor (not shown) via a timing belt or the like.

The apparatus main body 1 further includes an ejection unit configured to eject the sheet 42 that has been recorded by the recording head 34. The ejection unit includes a separating nail 61 for separating the sheet 42 from the transport belt 51, an ejection roller 62, and a spur 63. An ejected sheet tray 3 is installed below the ejection roller 62.

At the back of the apparatus main body 1, there is detachably mounted a double-side print unit 71. The double-side print unit 71 is configured to take in the sheet 42 as the sheet 42 is fed back by an inverse rotation of the transport belt 51. The double-side print unit 71 then feeds back the sheet 42 upside down between the counter roller 46 and the transport belt 51. An upper surface of the both-side print unit 71 provides a manual-feed tray 72.

With reference to FIG. 2, in a non-printed region on one side of the carriage 33 in the main scan direction, there is installed a maintain/restore mechanism 81 for maintaining or restoring the condition of the nozzles of the recording head 34. The maintain/restore mechanism 81 includes cap members 82*a* and 82*b* (which may be hereafter referred to collectively as a "cap 82") for capping the individual nozzle surfaces of the recording head 34.

The maintain/restore mechanism 81 also includes a wiper member (wiper blade) 83 for wiping the nozzle surfaces; a blank discharge receiver 84 for receiving unwanted droplets when a blank discharge is performed to discharge droplets that do not contribute to recording or to eject the recording fluid with increased viscosity; and a carriage lock 87 for locking the carriage 33.

Under the maintain/restore mechanism 81, there is provided a non-replaceable waste tank 100 for storing the waste fluid produced by the maintain/restore operation. Another waste tank 101 that is replaceable from the front of the apparatus main body 1 is provided on the side of the maintain/restore mechanism 81.

Still referring to FIG. 2, in a non-printed region on the other side of the carriage 33 in the main scan direction, there is installed a second blank discharge receiver 88. The second blank discharge receiver 88 is configured to receive unwanted droplets when a blank discharge is performed to discharge droplets that do not contribute to recording or to eject the recording fluid with increased viscosity during recording. The blank discharge receiver 88 includes an opening portion 89 that extends along the lines of the recording head nozzles.

The sheets 42 are individually separated from the sheet-feed tray 2 and fed upward substantially vertically, while being guided by the guide 45. The sheet 42 is then held and transported between the transport belt 51 and the counter roller 46. The sheet 42 is further transported with its front end guided by the transport guide 37, and is then pressed against the transport belt 51 by the edge pressurizing roller 49 while the transport direction is changed by substantially 90°.

During a recording operation, the charge roller 56 is supplied with alternating positive and negative voltages, so that the transport belt 51 is charged with an alternately charged voltage pattern. The pattern consists of bands of predetermined widths of positive and negative potentials alternating along the rotating direction, which is the sub-scan direction. When the sheet 42 is fed onto the positively and negatively charged transport belt 51, the sheet 42 electrostatically sticks to the transport belt 51. Thus, the sheet 42 is transported in the sub-scan direction as the transport belt 51 rotates.

The recording head 34 is driven based on an image signal while the carriage 33 is moved. Thus the recording head 34 discharges ink droplets in accordance with the image signal, forming one line of an image on the sheet 42 when the sheet 42 is stationary. After the sheet 42 is transported in the sub-scan direction by a predetermined amount, the next line of image is recorded. The recording operation is terminated upon reception of a record-end signal or a signal indicating the arrival of the rear-end of the sheet 42 at the recording region. Finally, the sheet 42 is ejected onto the ejected sheet tray 3.

When the nozzle maintain/restore operation is performed, the carriage 33 is moved to the home position which is the position opposite the maintain/restore mechanism 81. The heads are then capped with the cap member 82, and the maintain/restore operation is performed. The maintain/restore operation may involve sucking the nozzles or performing a blank discharge to discharge ink droplets that do not contribute to image formation. In this way, a stable image formation can be ensured.

Hereafter, an ink supply system for the image forming apparatus according to an embodiment of the present invention is described with reference to FIG. 3.

Figure 3:
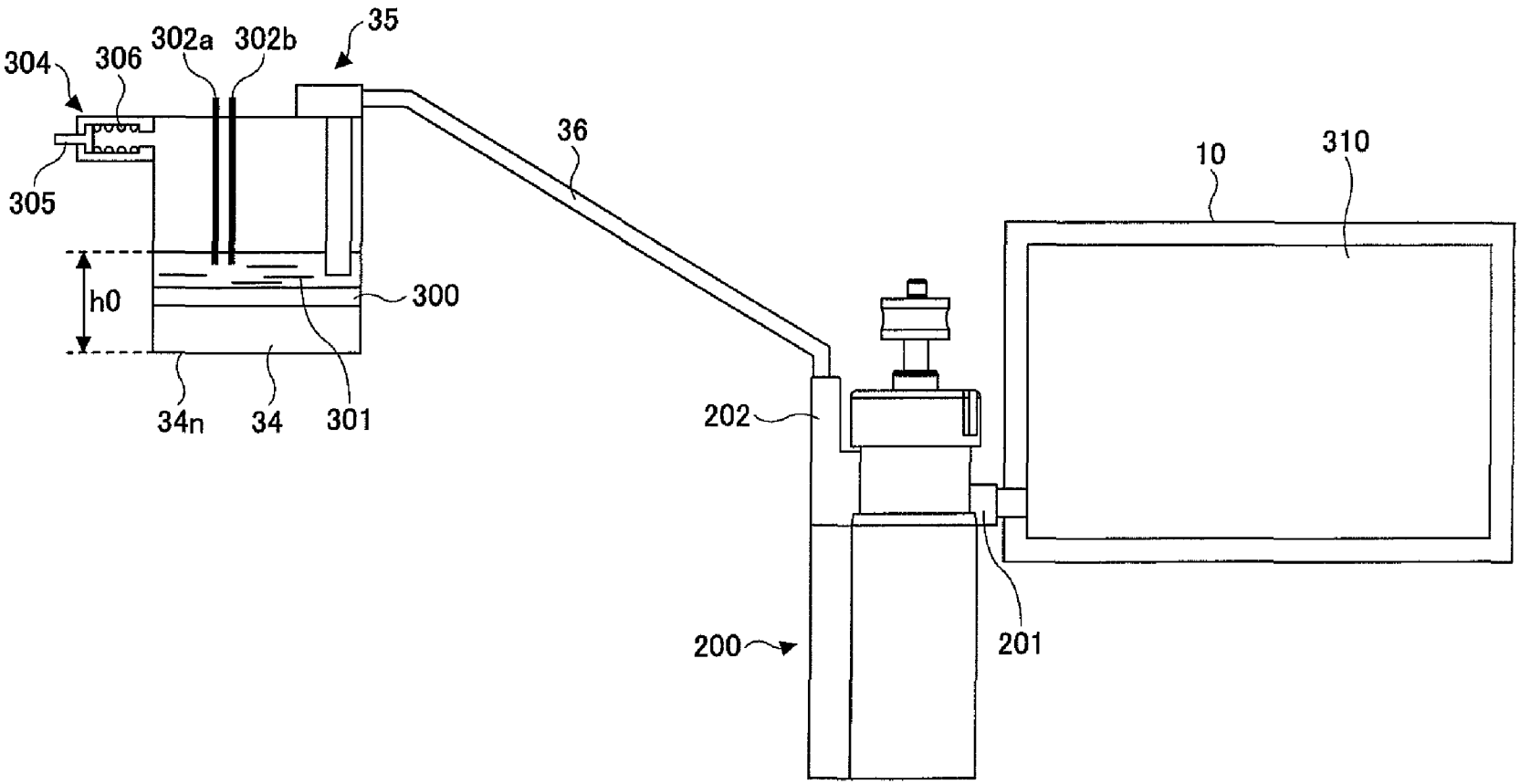
FIG. 3 schematically shows an ink supply system in the image forming apparatus.

As shown in FIG. 3, the recording head 34 is integrally fitted with the sub-tank 35 via a filter 300. The sub-tank 35 includes a pair of detecting electrodes 302*a* and 302*b* which are metal members configured to detect the presence or absence of ink 301 within the sub-tank 35. The sub-tank 35 also includes an atmosphere opening unit 304 for opening the inside of the sub-tank 35 to the atmosphere.

One of the pair of the detecting electrodes 302*a* and 302*b* is connected to a positive potential while the other is connected to a negative potential. Thus, the electric resistance between the detecting electrodes 302*a* and 302*b* varies between when they are in contact with the ink 301 and when they are not, thus enabling the detection of the ink 301.

The atmosphere opening unit 304 includes a pressing pin 305, which may have a packing portion integrally formed from a resilient material by double molding or the like. The pressing pin 305 is biased toward the outside by a spring 306 installed within the sub-tank 35 so that the atmosphere and the inside of the sub-tank 35 are normally isolated. When the pressing pin 305 is pressed from the outside against the force of the spring 306, the inside of the sub-tank 35 can be opened to the atmosphere. The sub-tank 35 also includes a pressure detecting unit 402 for detecting a pressure within the sub-tank 35.

The main tank 10 contains an ink bag 310 that is deformable by an external pressure. The ink bag 310 is configured to be connected to a hollow supply needle of a fluid supply apparatus (reversible piston pump) 200 when the main tank 10 is attached to the apparatus main body 1. The fluid supply apparatus 200 corresponds to the supply pump unit 24 shown in FIG. 2.

The fluid supply apparatus 200 and the sub-tank 35 are connected via the supply tube 36, so that the sub-tank 35 can be refilled with the ink 301 from the main tank 10 by driving the fluid supply apparatus 200. At the end of the initial filling of the sub-tank 35, the ink level within the sub-tank 35 is at a height h0 from a nozzle surface 34*n* of the recording head 34.

The fluid supply apparatus 200 includes first and second supply/discharge openings 201 and 202 for supplying or discharging a fluid, as will be described later. In the example shown in FIG. 3, the first supply/discharge opening 201 is connected to the ink bag 310 in the ink tank 10, while the second supply/discharge opening 202 is connected to the supply tube 36. In the fluid supply apparatus 200, the fluid is transported from the first supply/discharge opening 201 toward the second supply/discharge opening 202 in a forward rotation operation. The fluid is transported from the second supply/discharge opening 202 toward the first supply/discharge opening 201 in a backward rotation operation.

Figure 4:
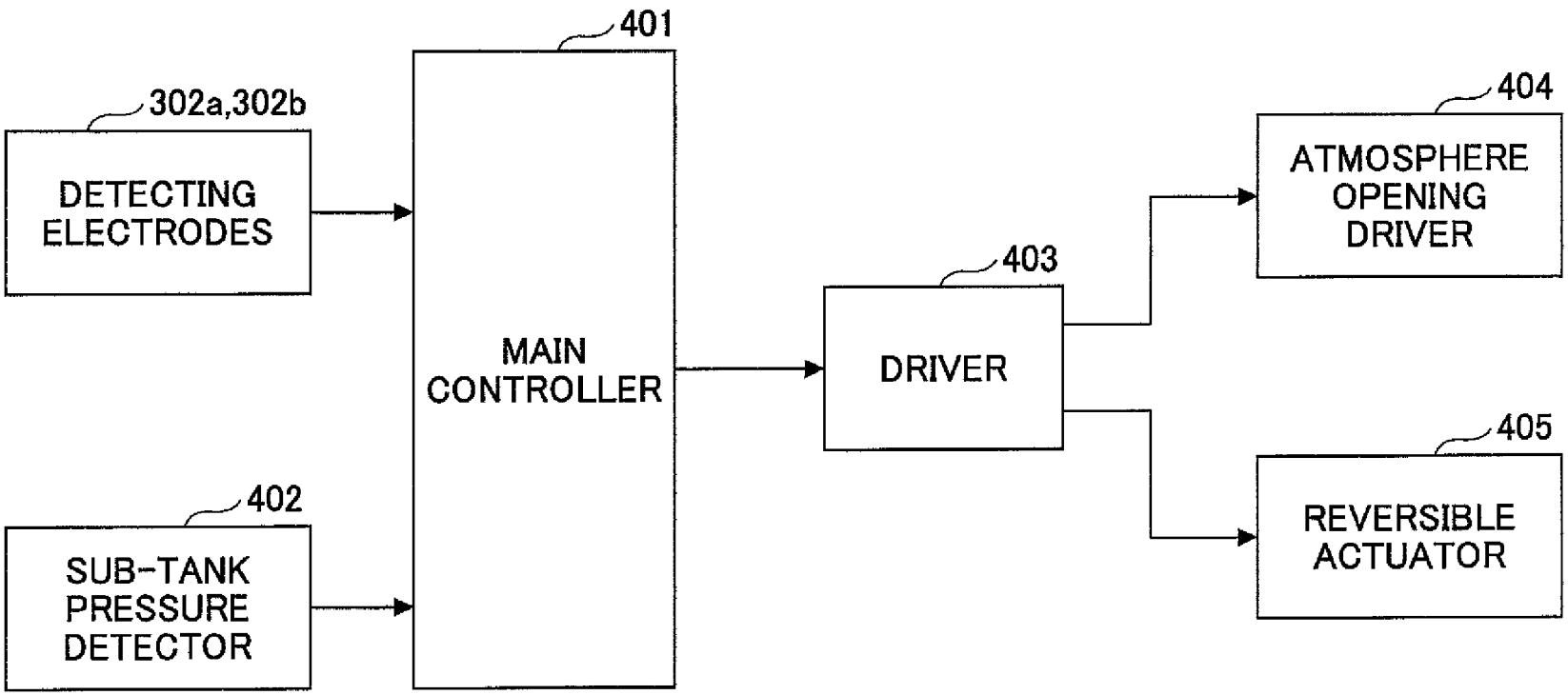
FIG. 4 shows a block diagram of an ink supply control system according to an embodiment of the present invention.

Hereafter, a control portion of the ink supply system shown in FIG. 3 is described with reference to a block diagram shown in FIG. 4.

A main control unit 401 is configured to control the image forming apparatus as a whole and may include a microcomputer such as a central processing unit (CPU). In order to control the ink supply system, the presence or absence of the ink 301 in the sub-tank 35 is detected based on a detection signal supplied from the detecting electrodes 302*a* and 302*b*. The pressure within the sub-tank 35 is also detected by the pressure detecting unit (pressure sensor) 402, supplying a pressure detection signal. Based on these detection results, the atmosphere-opening drive unit (which may include a solenoid) 404 for controlling the pressing pin 305 is controlled via a driver 403, thus controlling the opening and closing of the atmosphere opening unit 305. A reversible actuator (which may be a motor) 405 for driving the fluid supply apparatus 200 is also controlled in order to control the supply/discharge of the ink in the fluid supply apparatus 200.

Hereafter, a description is given of how the apparatus is controlled by the main control unit 401 when air enters the sub-tank 35 from the outside, bringing the pressure therein below a predetermined negative pressure (such as close to zero), with reference to a flowchart shown in FIG. 5.

Suppose now that a decrease in the negative pressure within the sub-tank 35 is detected by the pressure sensor 402 ("YES" in S501). Then, unless the absence of ink is detected based on a detection signal from the detecting electrodes 302*a* and 302*b* ("YES" in S502), the reversible actuator 405 is controlled so that the fluid supply apparatus 200 performs the backward rotation operation (S503). The backward rotation operation reduces the pressure inside the supply tube (ink supply channel) 36, whereby the ink 301 can be fed from the sub-tank 35 back to the main tank 10. As a result, a predetermined initial negative pressure can be restored in the sub-tank 35 (S504).

On the other hand, when the absence of ink is detected ("YES" in S502) based on the detection signal from the detecting electrodes 302*a* and 302*b* upon detection of the negative pressure decrease by the pressure sensor 402 (S501), the atmosphere open drive unit 403 is driven to press the pressing pin 305 in order to communicate the inside of the sub-tank 35 with the atmosphere (S505). Thereafter, the reversible actuator 405 is controlled so that the fluid supply apparatus 42 performs the forward rotation operation (S506). The forward rotation operation increases the pressure inside the supply tube (ink supply channel) 36, whereby the ink 301 can be supplied from the main tank 10 to the sub-tank 35 until the sub-tank 35 is filled (S507).

The forward rotation operation of the fluid supply apparatus 200 is continued until the sub-tank 35 is filled with a predetermined amount of the ink 301 from the main tank 10, based on the duration of rotation (S508). After the atmosphere opening unit 304 is stopped (thereby blocking the atmosphere) (S509), the fluid supply apparatus 200 is controlled to perform the backward rotation operation (S510). The backward rotation operation restores a predetermined initial negative pressure in the sub-tank 35, so that a small amount of the ink 301 can be returned from the sub-tank 35 back to the main tank 103.

Hereafter, a description is given of how the apparatus is controlled when the negative pressure inside the sub-tank 35 increases above the predetermined negative pressure as a result of consumption of the ink by the printing operation, with reference to a flowchart shown in FIG. 6.

When the ink is consumed by the printing operation and the negative pressure within the sub-tank 35 exceeds the predetermined negative pressure ("YES" in S601), unless the ink is absent, the fluid supply apparatus 200 is controlled to perform the forward rotation operation without actuating the atmosphere opening unit 304 within the sub-tank 35 (S603). The forward rotation operation pressurizes the inside of the supply tube (ink supply channel) 36 so that the predetermined initial negative pressure can be restored within the sub-tank 35 (S604). As a result, the sub-tank 35 can be filled with the ink 301 from the main tank 10.

On the other hand, when there is no ink ("YES" in S602) upon detection of the excess pressure within the sub-tank 35 ("YES" in S601), the atmosphere opening unit 304 within the sub-tank 35 is actuated so as to communicate the inside of the sub-tank 35 with the atmosphere (S605). The forward rotation operation of the fluid supply apparatus 200 is continued (S606) to pressurize the inside of the supply tube (ink supply channel) 36 until the ink is detected in the sub-tank 35 (S607). When the sub-tank 35 is filled with the predetermined amount of ink from the main tank 10 based on the duration of rotation of the fluid supply apparatus 200 (S608), the atmosphere opening unit 304 is stopped (thus blocking the atmosphere) (S609). Thereafter, the fluid supply apparatus 200 is controlled to perform the backward rotation operation (S610) so that the predetermined initial negative pressure can be restored within the sub-tank 35 and a small amount of ink can be returned from the sub-tank 35 to the main tank 10.

In this way, the predetermined negative pressure can be restored within the sub-tank without producing waste ink, whereby a constant amount of ink can be maintained in the sub-tank.

Hereafter, another example of the ink supply system for the image forming apparatus is described with reference to FIG. 7.

Figure 7:
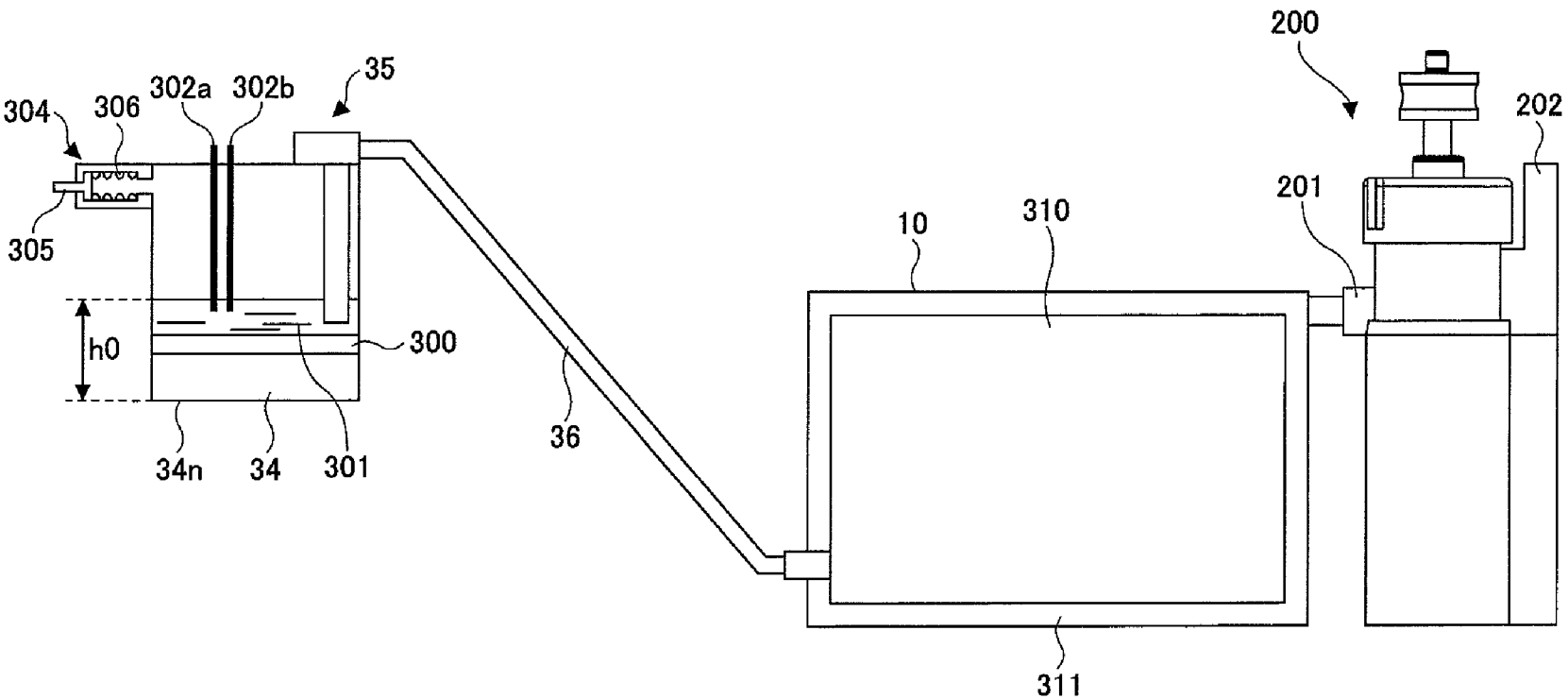
FIG. 7 schematically shows an ink supply system according to another embodiment of the present invention.

In this example, the first supply/discharge channel 201 of the fluid supply apparatus 200 is connected to a space 311 between a tank main body of the main tank 10 and the ink bag 310, as shown in FIG. 7.

In accordance with this embodiment, air as a fluid is sucked in via the second supply/discharge opening 202 of the fluid supply apparatus 200. The air is then sent into the space 311 of the main tank 10 via the first supply/discharge opening 201. As a result, the ink bag 310 collapses, causing the ink to be supplied from the ink bag 310 to the supply tube (ink supply channel) 36. Conversely, the air within the space 311 of the main tank 10 can be sucked out via the first supply/discharge opening 201 and discharged via the second supply/discharge opening 202. In this case, a negative pressure is produced within the space 311 of the main tank 10, thereby causing the ink bag 310 to swell and returning the ink from the supply tube (ink supply channel) 36 back to the ink bag 310.

The controls exerted for adjusting the amount of ink within the sub-tank 35 and the restoration of the predetermined negative pressure therein may be the same as in the foregoing example.

Figure 8:
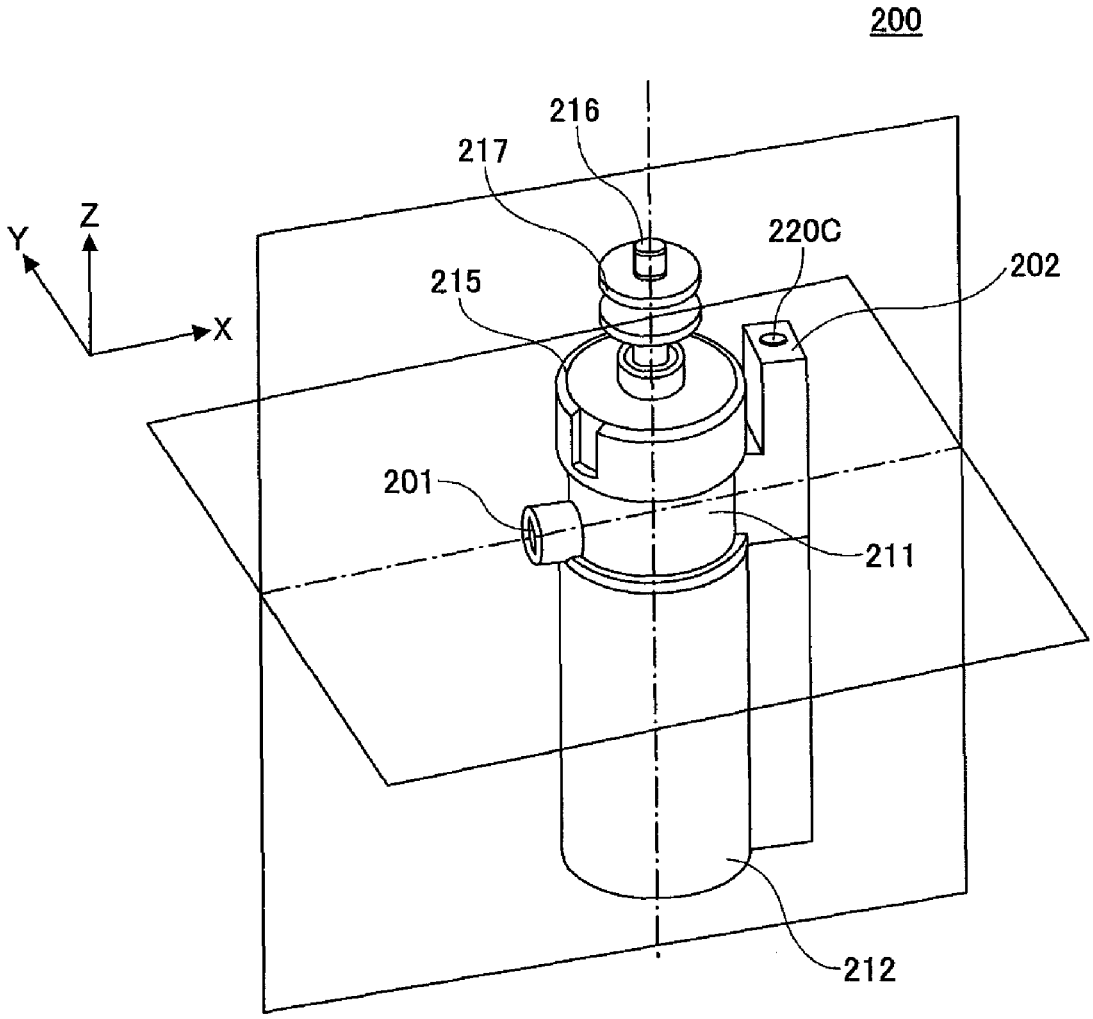
FIG. 8 shows a perspective view of a fluid supply apparatus according to an embodiment of the present invention.
Figure 9:
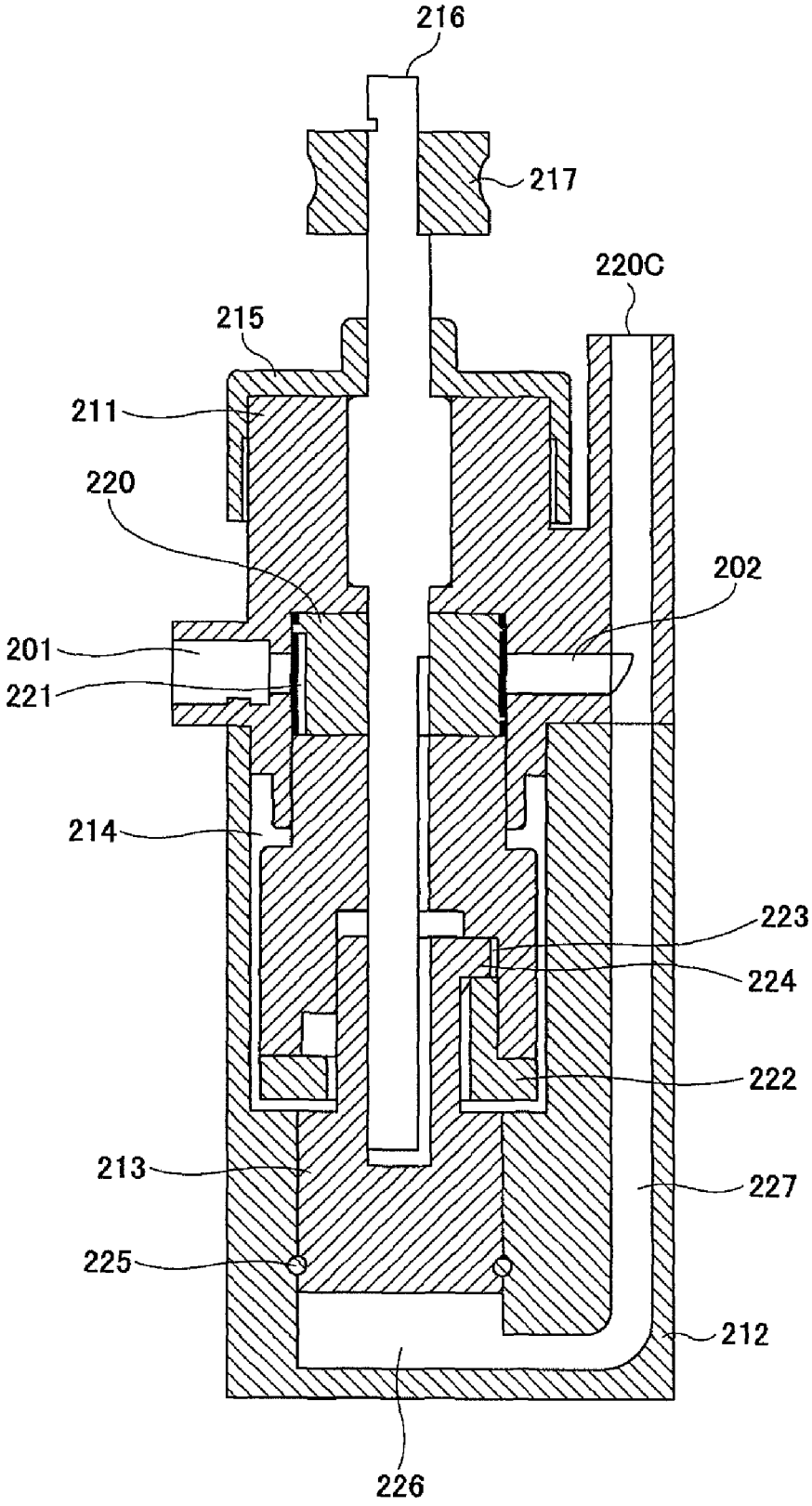
FIG. 9 shows a cross section of the fluid supply apparatus taken in an X-Z plane of FIG. 8.
Figure 10:
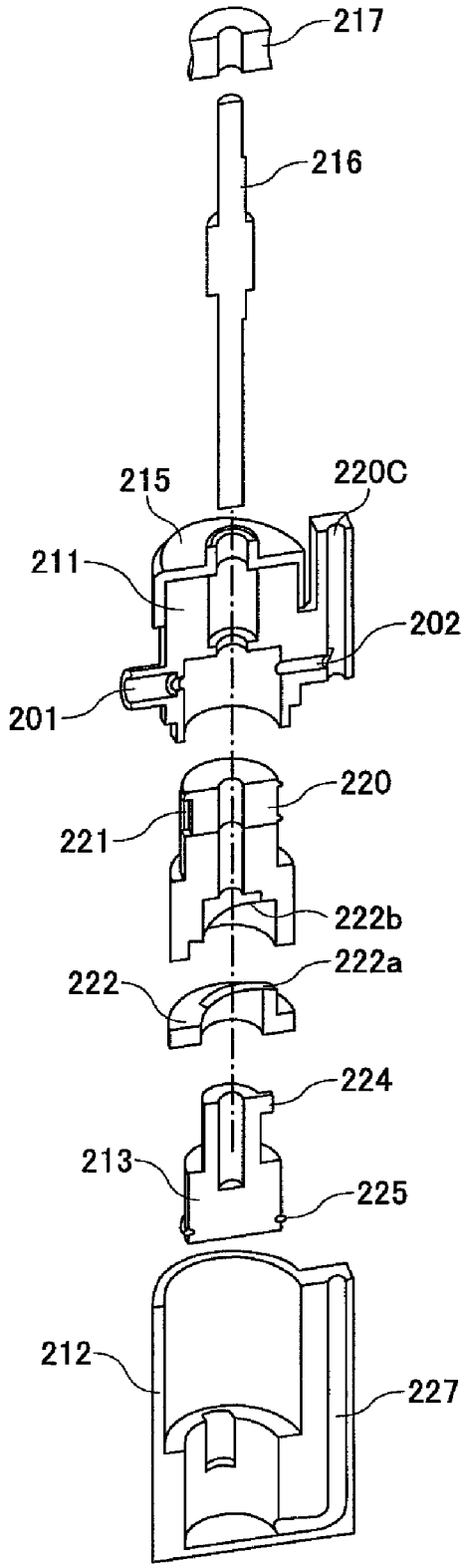
FIG. 10 shows a broken perspective view of the fluid supply apparatus in a cross section taken in the X-Z plane of FIG. 8.

Hereafter, a fluid supply apparatus according to an embodiment of the present invention is described with reference to FIGS. 8 through 10. FIG. 8 shows a perspective view of the fluid supply apparatus 200. FIG. 9 shows a cross section of the fluid supply apparatus 200 taken in an X-Z plane of FIG. 8. FIG. 10 shows a broken perspective view of the fluid supply apparatus 200 in a cross section taken in the X-Z plane of FIG. 8.

The fluid supply apparatus 200 includes an upper cylinder 211 and a lower cylinder 212. The upper cylinder 211 has a first supply/discharge opening 201 and a second supply/discharge opening 202 for supplying or discharging a fluid. In the lower cylinder 212, a piston 213 is movably (vertically in the illustrated example) disposed as shown in FIG. 9. Between the upper cylinder 211 and the lower cylinder 212, there is formed a cylinder internal chamber 214 for accommodating the fluid.

By the upper cylinder 211 and the cap 215, a drive transmission shaft 216 that penetrates the cylinder is rotatably retained. At the external end of the drive transmission shaft 216, there is attached a gear 217. Via the gear 217, the drive transmission shaft 216 is rotated by the aforementioned reversible actuator 405, which can be rotated in both the forward and backward directions.

Within the upper cylinder 211, a fluid channel open/close member 220 is rotatably disposed in sliding contact with the internal walls of the upper cylinder 211. The fluid channel open/close member 220 is rotated by the drive transmission shaft 216.

The fluid channel open/close member 220 is a rotating valve with a cutout portion 221 formed on the outer circumference. The fluid channel open/close member 220 is configured to form or block a channel communicating the first or the second supply/discharge opening 201 or 202 with the cylinder internal chamber 214, while closing either the first or the second supply/discharge opening 201 or 202 at any time. Specifically, the cutout portion 221 is formed on the outer circumference of the open/close member 220 at such an angle with respect to the angles at which the first and the second supply/discharge openings 201 and 202 are formed in the upper cylinder 211 that either the first or the second supply/discharge opening 201 or 202 is closed at any time.

Thus, the fluid channel open/close member 220 rotates while maintaining a certain contact force with respect to the internal walls of the upper cylinder 211, so that the channels from the first and the second supply/discharge openings 201 and 202 can be sequentially switched.

The fluid channel open/close member 220 may be formed of an engineering plastic for the internal structure and a resilient member such as an elastomer or rubber for the outer periphery.

As shown in FIGS. 9 and 10, the fluid channel open/close member 220 is internally fitted with a cylindrical cam 222 at the bottom. The cylindrical cam 222 may be integrally formed by double molding. A cam face 222*a* of the cylindrical cam 222 and a cam face 222*b* of the channel forming member 220 form a cam groove 223. In the cam groove 223, there is slidably fitted a cam pin portion 224 of the piston 213.

The piston 213 is slidably mounted on the drive transmission shaft 216. Namely, the drive transmission shaft 216 provides a guide member for the piston 213. Thus, as the fluid channel open/close member 220 rotates, the cam pin portion 224 of the piston 213 moves along the cam groove 223, so that the piston 213, being guided by the cam groove 223, moves back and forth (up and down) along the drive transmission shaft 216.

Thus, the cam mechanism (including the cam groove 223 and the cam pin portion 224) provides a linkage between the rotation of the fluid channel open/close member 220 and the movement of the piston 213.

An O-ring 225 made of resilient material such as an elastomer or rubber is fitted on the outer periphery of the piston 213 in order to seal between the piston 213 and the lower cylinder 212.

The lower cylinder 212 includes a communicating channel 227 communicating a chamber 226, which is formed between a bottom surface of the lower cylinder 212 and the piston 213, and the second supply/discharge opening 202.

Figure 18:
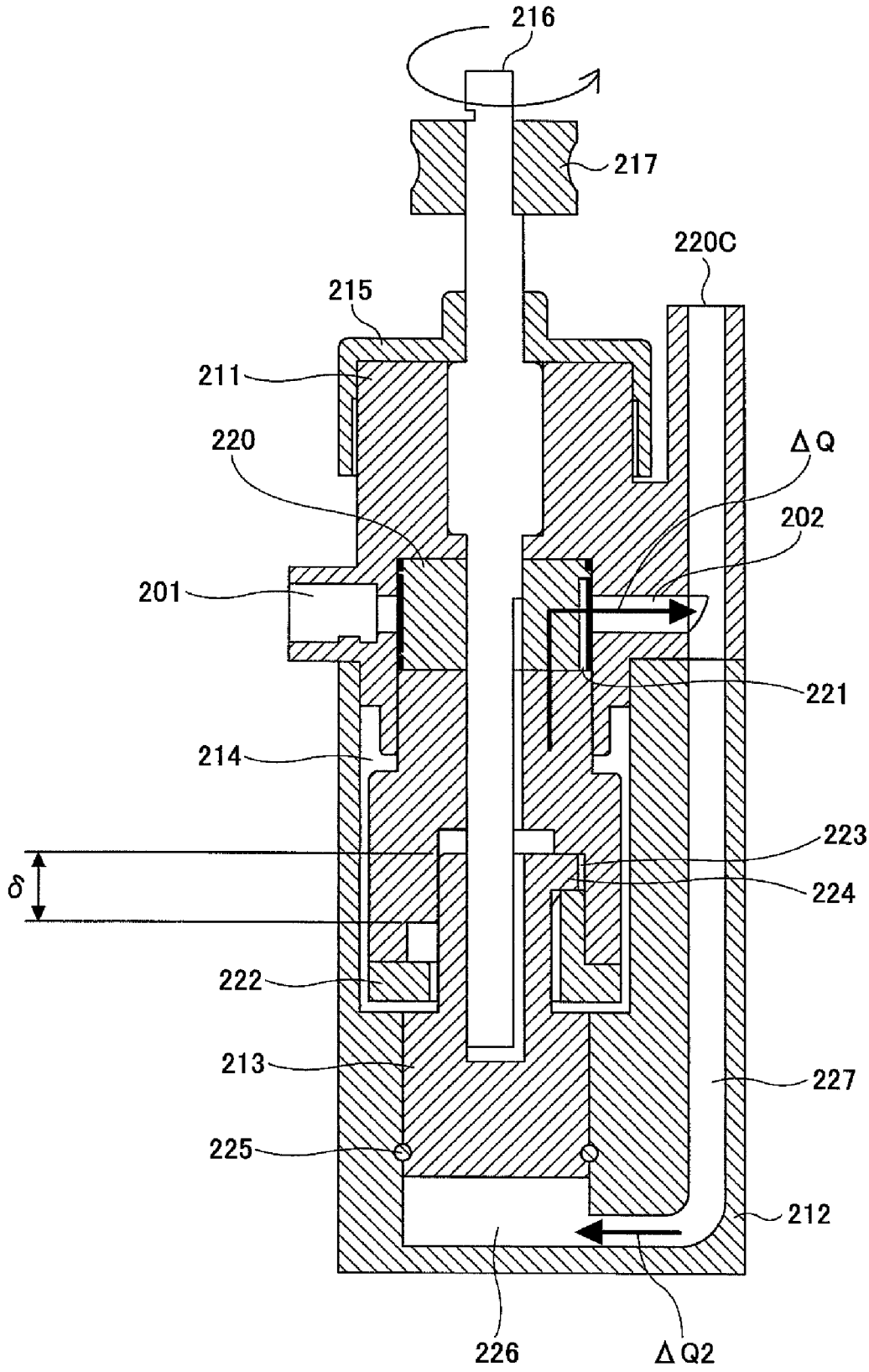
FIG. 18 shows a similar cross section illustrating a displaced position of the piston when the fluid channel open/close member is at the rotation angle 300°.
Figure 19:
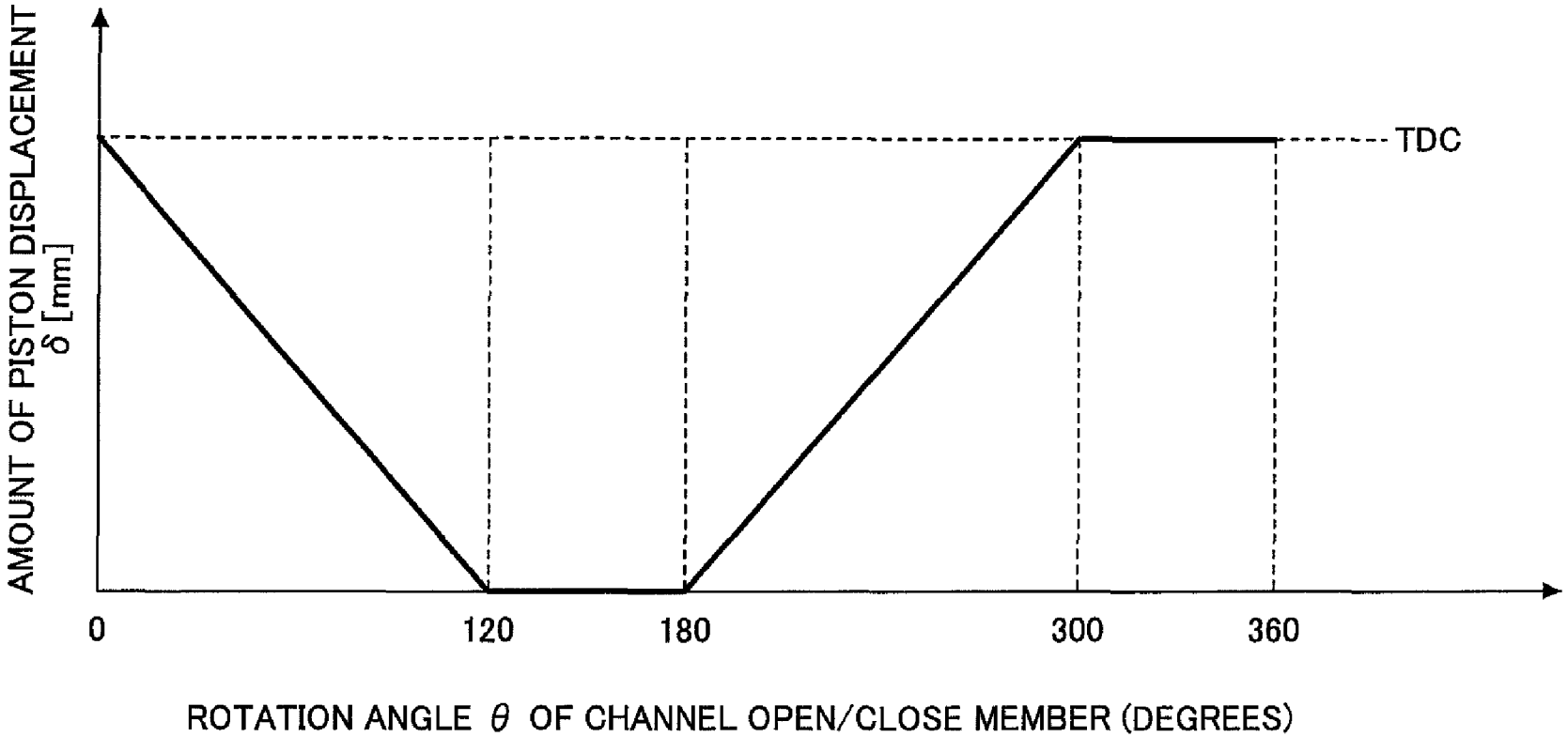
FIG. 19 shows a graph showing a plot of the amount of displacement of the piston versus the rotation angle of the fluid channel open/close member.

In the following, a description is given of an operation for sucking or discharging a fluid using the fluid supply apparatus 200 with reference to FIGS. 11 through 19. The fluid is assumed to be a liquid in the following description. FIGS. 11 through 14 show cross sections taken in the X-Y plane of FIG. 8 for describing the rotation angle of the fluid channel open/close member 220. FIGS. 15 through 18 show cross sections for describing the change in position of the piston relative to the rotation angle of the fluid channel open/close member shown in FIGS. 11 through 14. FIG. 19 shows a graph showing a plot of the amount of displacement of the piston versus the rotation angle of the fluid channel open/close member.

Figure 11:
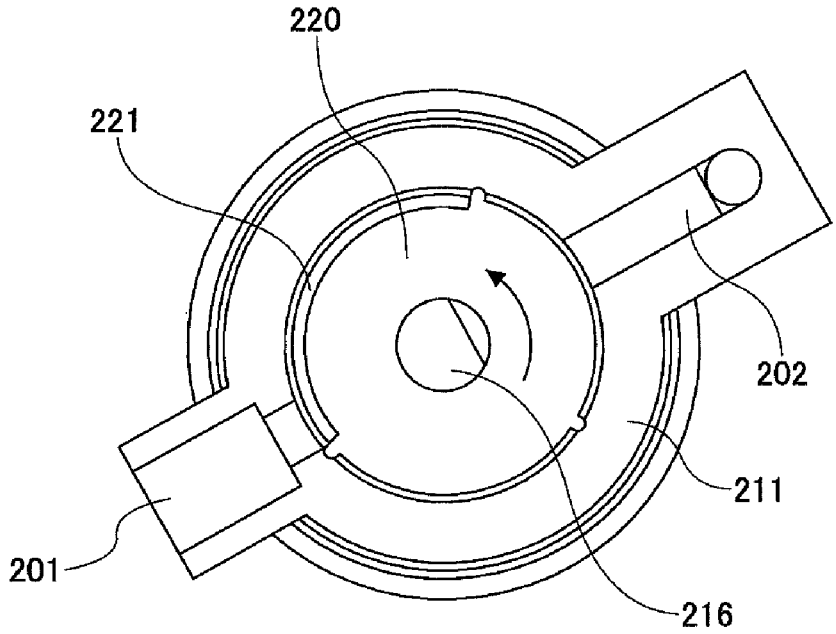
FIG. 11 shows a cross section of the fluid supply apparatus taken in an X-Y plane of FIG. 8, showing the fluid channel open/close member at an initial position (where the rotation angle is 0°)
Figure 15:
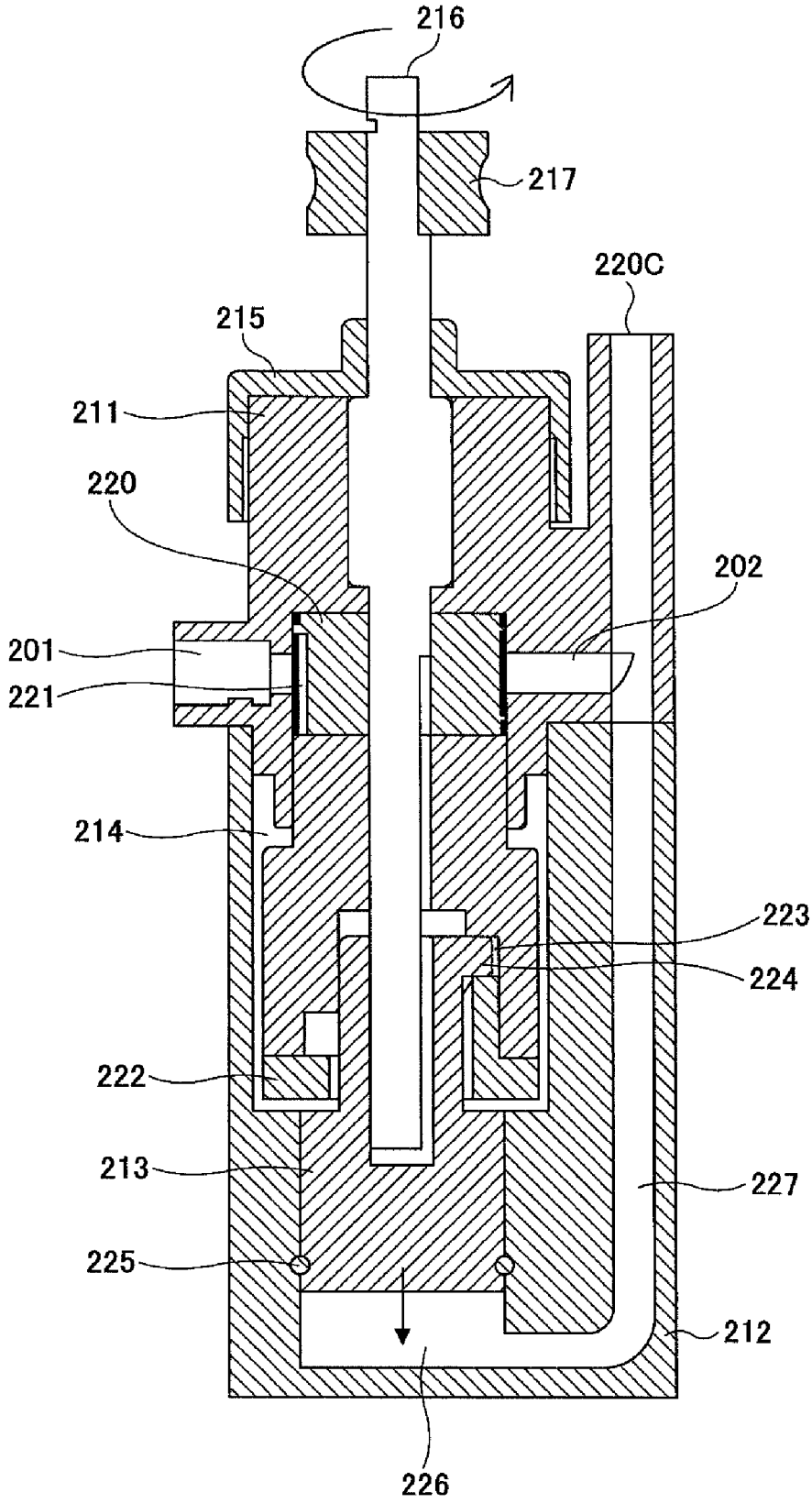
FIG. 15 shows a cross section taken in the X-Z plane of FIG. 8, illustrating a displaced position of the piston when the fluid channel open/close member is at the rotation angle 0°.

As shown in FIG. 11, when the rotation angle is zero, the cutout portion (channel) 221 of the fluid channel open/close member 220 is opposite the first supply/discharge opening 201. Thus the first supply/discharge opening 201 is communicated with the cylinder internal chamber 214 via the channel 221, while the channel between the second supply/discharge opening 202 and the cylinder internal chamber 214 is blocked. At this time, the piston 213 is at the top dead center position, as shown in FIG. 15.

Figure 12:
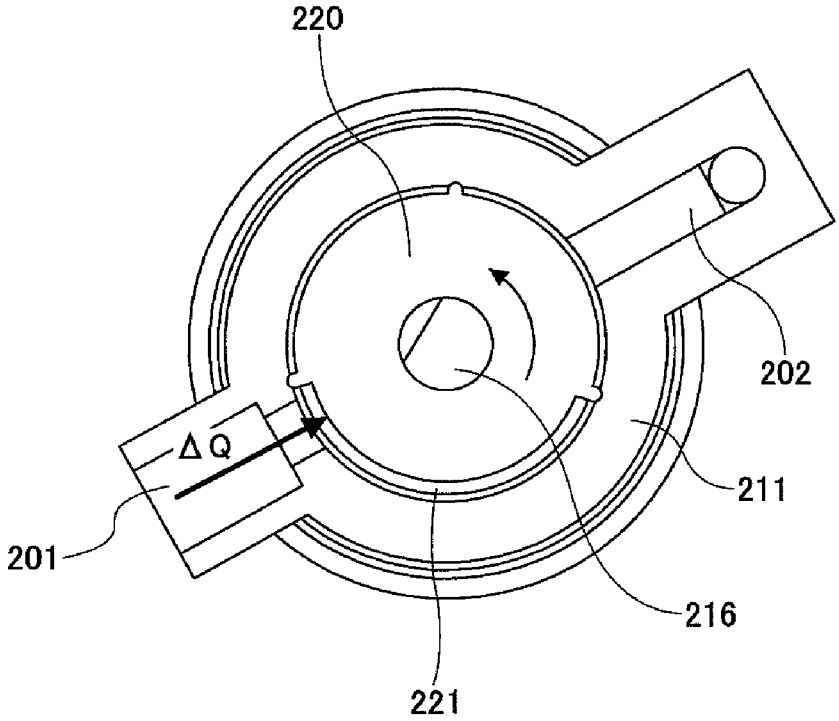
FIG. 12 shows a similar cross section when the fluid channel open/close member is positioned at the rotation angle 120°.

As the fluid channel open/close member 220 rotates in the direction of arrow by 120°, the fluid channel open/close member 220 takes a position shown in FIG. 12. During the rotation of the fluid channel open/close member 220, the channel 221 remains positioned opposite the first supply/discharge opening 201, so that the first supply/discharge opening 201 and the cylinder internal chamber 214 are communicated via the channel 221. On the other hand, the channel between the second supply/discharge opening 202 and the cylinder internal chamber 214 remains blocked.

Figure 16:
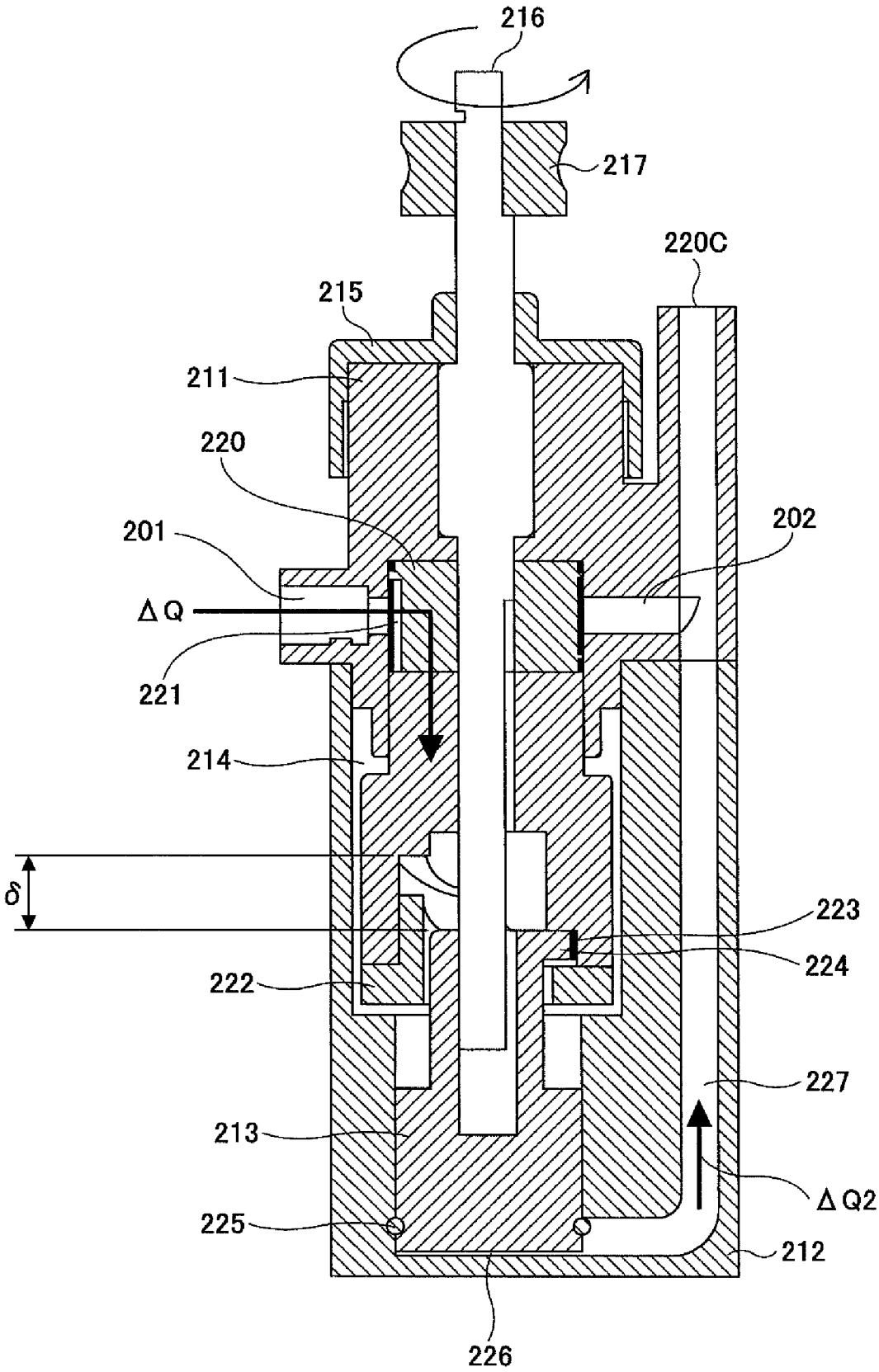
FIG. 16 shows a similar cross section illustrating a displaced position of the piston when the fluid channel open/close member is at the rotation angle 120°.

As the fluid channel open/close member 220 rotates, the cam pin portion 224 of the piston 213 moves along the cam groove 223. As a result, the piston 213 is lowered from its initial position by a displacement $\delta$, down to the bottom dead center, as shown in FIG. 16. This causes a fluid $\Delta Q$ to be sucked via the first supply/discharge opening 201 into the cylinder internal chamber 214.

Figure 13:
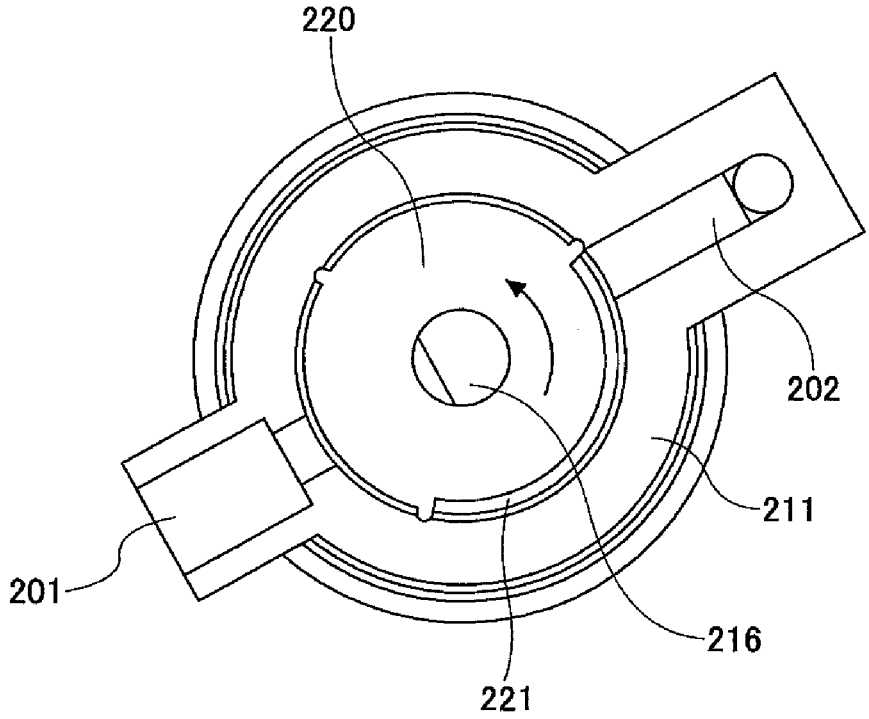
FIG. 13 shows a similar cross section when the fluid channel open/close member is positioned at the rotation angle 180°.

As shown in FIG. 13, as the fluid channel open/close member 220 further rotates in the direction of arrow by 60°, the fluid channel open/close member 220 is positioned at the rotation angle of 180° with respect to the initial position. During the rotation of the fluid channel open/close member 220, the channel 221 passes the first supply/discharge opening 201, whereby the first supply/discharge opening 201 is blocked from the cylinder internal chamber 214. On the other hand, the channel 221 is positioned opposite the second supply/discharge opening 202, thus communicating the cylinder internal chamber 214 and the second supply/discharge opening 202.

Figure 17:
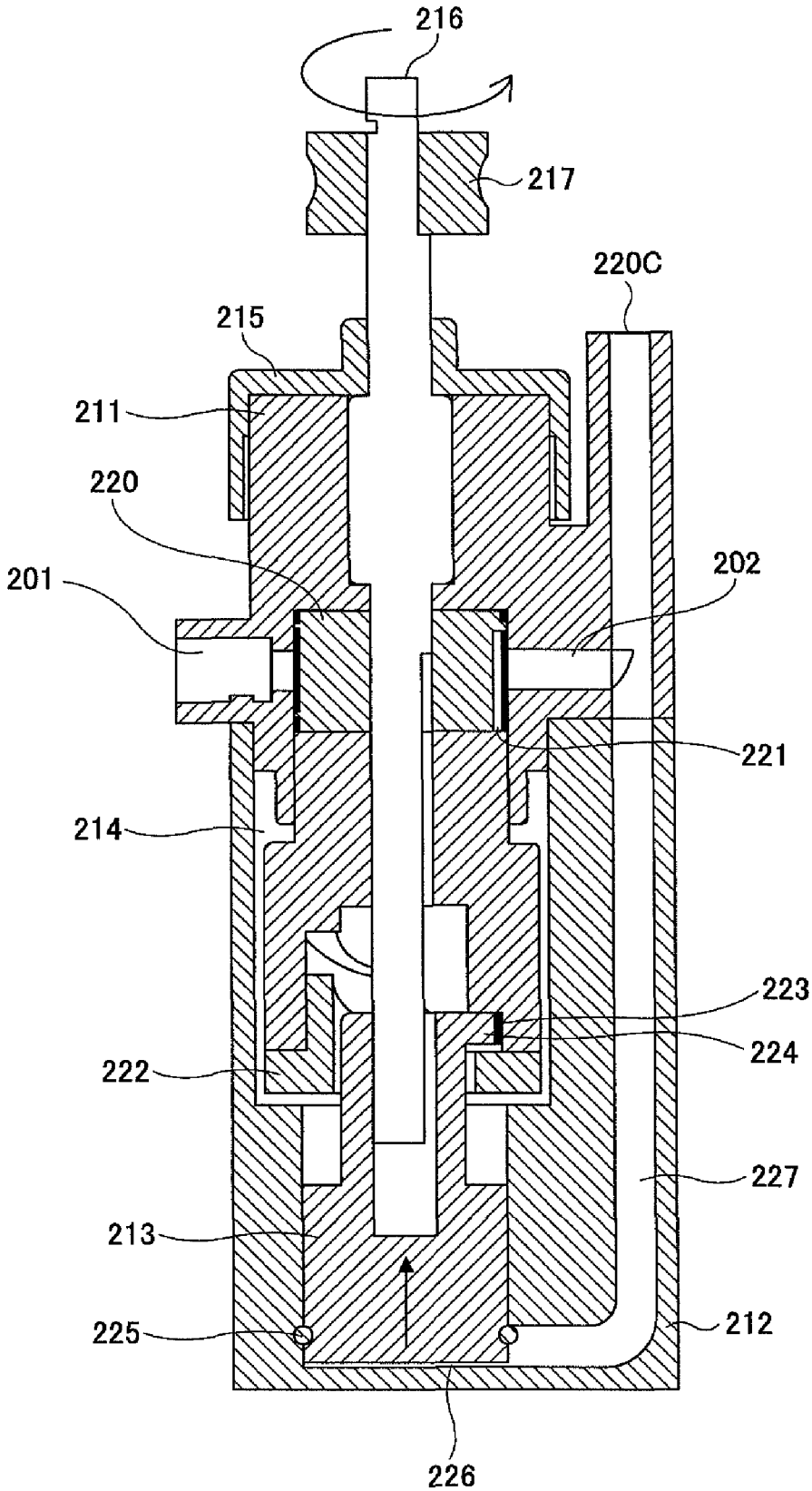
FIG. 17 shows a similar cross section illustrating a displaced position of the piston when the fluid channel open/close member is at the rotation angle 180°.

At this time, the piston 213 remains retained at the bottom dead center, as shown in FIG. 17, due to the shape of the cam groove 223. Thus, the fluid ΔQ remains trapped within the cylinder internal chamber 214.

Figure 14:
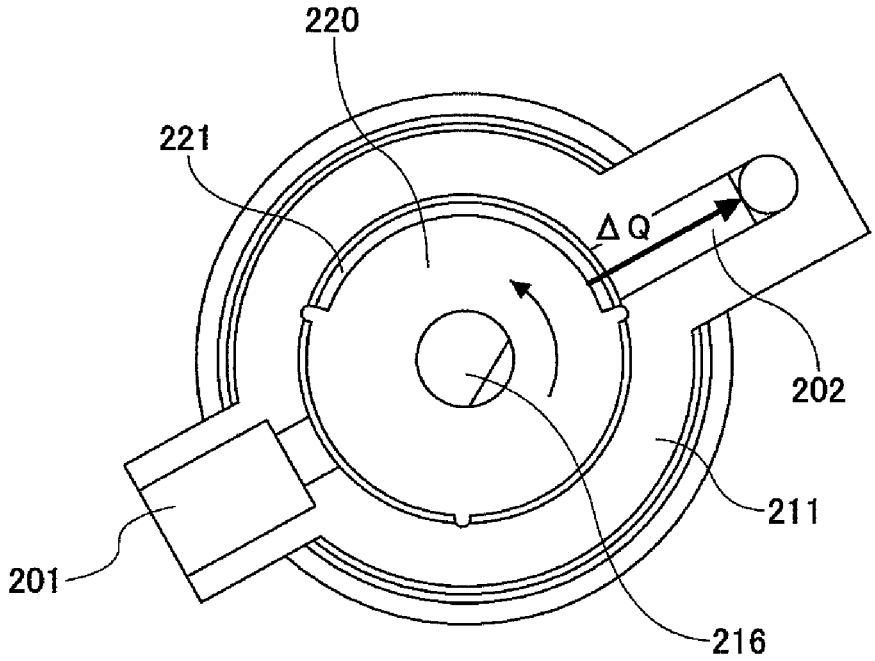
FIG. 14 shows a similar cross section when the fluid channel open/close member is positioned at the rotation angle 300°.

As the fluid channel open/close member 220 is further rotated by 120° in the direction of arrow, the fluid channel open/close member 220 is positioned at the rotation angle of 300° from the initial position, as shown in FIG. 14. During the rotation of the fluid channel open/close member 220, the channel 221 remains opposite the second supply/discharge opening 202, so that the second supply/discharge opening 202 is communicated with the cylinder internal chamber 214 via the channel 221. On the other hand, the channel between the first supply/discharge opening 201 and the cylinder internal chamber 214 remains blocked.

At this time, the cam pin portion 224 of the piston 213 moves along the cam groove 223 due to the rotation of the fluid channel open/close member 220. As a result, the piston 213 is moved up from the bottom dead center to the top dead center by the displacement δ, as shown in FIG. 18. Thereby, the fluid ΔQ in the cylinder internal chamber 214 is ejected via the second supply/discharge opening 202.

When the rotation angle of the fluid channel open/close member 220 is within 300° to 360° with respect to the initial position, the piston 213 remains at the top dead center (TDC) position, as seen from FIG. 19. Within these angles, the channel 221 of the fluid channel open/close member 220 is positioned opposite to neither the first supply/discharge opening 201 or the second supply/discharge opening 202. In this state, the communication between the first and the second supply/discharge openings 201 and 202 and the cylinder internal chamber 214 is blocked.

When the fluid channel open/close member 220 is rotated in the opposite direction to the above direction, the fluid ΔQ is sucked via the second supply/discharge opening 202 and ejected via the first supply/discharge opening 201.

Thus, the fluid supply apparatus according to the present embodiment includes the cylinder having the first and the second supply/discharge openings for supplying or discharging a fluid; the piston movably disposed within the cylinder and forming a chamber with the cylinder; the rotating channel open/close unit rotatably disposed within the cylinder and configured to form or block the channel communicating the first or the second supply/discharge opening with the chamber in the cylinder, wherein the first supply/discharge opening or the second supply/discharge opening, or both, remains closed at any time; and the linking unit that links the rotation of the channel open/close unit and the movement of the piston.

When the channel open/close unit rotates in one direction, the fluid flows into the chamber via the first supply/discharge opening and is discharged via the second supply/discharge opening. When the rotating channel open/close unit rotates in the other direction, the fluid flows into the chamber via the second supply/discharge opening and is discharged via the first supply/discharge opening. Thus, the fluid transport direction can be easily changed.

In this embodiment, the fluid supply apparatus does not employ highly permeable members such as a diaphragm. Thus, a high barrier property and durability can be maintained against fluids. At the same time, when the fluid supply apparatus is stopped, the first and the second supply/discharge openings can be closed, thereby preventing the transmission of external pressure.

A communicating channel 227, which communicates the chamber 226 formed between the bottom surface of the lower cylinder 212 and the piston 213 with the second supply/discharge opening 202, provides the following effect. Namely, an amount ΔQ2 of the air within the chamber 226 below the piston 213 is ejected when the piston 213 reaches the bottom dead center (see FIG. 16). When the piston 213 reaches the top dead center, the same amount ΔQ2 is sucked into the region below the piston 213 again. At this time, however, the amount ΔQ of the fluid (liquid) is discharged via the second supply/discharge opening 202 of the upper cylinder 211, so that the total amount of the liquid ejected via the final ejection opening 220C of the second supply/discharge opening 202 is ΔQ (ΔQ2=ΔQ).

By continuously performing the above operation, the air within the chamber 226 below the piston 213 rises due to its buoyancy and the chamber 226 is eventually substituted with the liquid.

The image forming apparatus according to an embodiment of the present invention may be applied to not just an inkjet printer but also a facsimile machine, a copier, a printer, or a multifunction peripheral. The image forming apparatus may also be adapted for discharging a fluid other than ink, such as a recording fluid, a resist, or a DNA sample in the field of medicine.

Although this invention has been described in detail with reference to certain embodiments, variations and modifications exist within the scope and spirit of the invention as described and defined in the following claims.

The present application is based on the Japanese Priority Application No. 2008-142130 filed May 30, 2008, the entire contents of which are hereby incorporated by reference.

What is claimed is:

1. A fluid supply apparatus comprising:

a cylinder having a first supply/discharge opening and a second supply/discharge opening for supplying or discharging a fluid;

a piston movably disposed in the cylinder, the piston forming a chamber with the cylinder;

a rotating channel open/close unit movably disposed within the cylinder and configured to open or close a channel that communicates the first or the second supply/discharge opening with the chamber in the cylinder, wherein the rotating channel open/close unit closes at least one of the first and the second supply/discharge openings at any time; and a linking unit configured to link a rotation of the channel open/close unit and a movement of the piston, wherein the fluid is caused to enter the chamber via the first supply/discharge opening and exit via the second supply/discharge opening by the rotation of the channel open/close unit in one direction, and wherein the fluid is caused to enter the chamber via the second supply/discharge opening and exit the chamber via the first supply/discharge opening by the rotation of the channel open/close unit in another direction.

2. The fluid supply apparatus according to claim 1, wherein the channel open/close unit includes a cutout portion formed in a part of an outer periphery of the channel open/close unit, wherein the channel communicating the first or the second supply/discharge opening with the chamber in the cylinder is opened or closed by the rotation of the channel open/close unit relative to the cylinder.

3. The fluid supply apparatus according to claim 1, wherein the linking unit includes a cam mechanism configured to translate the rotation of the channel open/close unit into a reciprocal movement of the piston.

4. The fluid supply apparatus according to claim 1, including a transmission shaft configured to transmit a rotating force to the channel open/close unit, wherein the piston is attached to the transmission shaft reciprocally movably along the transmission shaft.

5. An image forming apparatus comprising the fluid supply apparatus according to claim 1.

* * * * *